US010072399B2

(12) United States Patent
Gilles

(10) Patent No.: US 10,072,399 B2
(45) Date of Patent: Sep. 11, 2018

(54) ELECTRICAL PIPE THAWING SYSTEM AND METHODS OF USING THE SAME

(71) Applicant: Michael John Gilles, Arlington Heights, IL (US)

(72) Inventor: Michael John Gilles, Arlington Heights, IL (US)

( * ) Notice: Subject to any disclaimer, the term of this patent is extended or adjusted under 35 U.S.C. 154(b) by 164 days.

(21) Appl. No.: 14/833,981

(22) Filed: Aug. 24, 2015

(65) Prior Publication Data

US 2016/0053468 A1 Feb. 25, 2016

Related U.S. Application Data

(60) Provisional application No. 62/040,737, filed on Aug. 22, 2014.

(51) Int. Cl.
*F16L 53/00* (2018.01)
*E03B 7/14* (2006.01)

(52) U.S. Cl.
CPC ..... *E03B 7/14* (2013.01)

(58) Field of Classification Search
CPC ..... E03B 7/14
USPC ..... 138/33, 35
See application file for complete search history.

(56) References Cited

U.S. PATENT DOCUMENTS 3,152,220 A * 10/1964 Gallacher ..... F16L 21/03 138/33
3,475,597 A * 10/1969 Desloge ..... B29C 45/1782 138/33
3,515,837 A * 6/1970 Ando ..... F16L 53/004 219/618
3,630,038 A * 12/1971 Ando ..... F16L 1/028 138/33
3,983,360 A * 9/1976 Offermann ..... F16L 53/004 137/341
4,132,884 A * 1/1979 Offermann ..... H05B 3/42 137/341
4,578,564 A * 3/1986 Ando ..... G01R 31/021 137/341
5,289,561 A * 2/1994 Costa Filho ..... F16L 11/127 137/341
2010/0206415 A1* 8/2010 Ellis ..... F16L 53/007 138/33
2014/0238523 A1* 8/2014 Wortmann ..... F16L 53/008 138/33

* cited by examiner

*Primary Examiner* — James Hook
(74) *Attorney, Agent, or Firm* — Scherrer Patent & Trademark Law, P.C.; Stephen T. Scherrer; Monique A. Morneault

(57) ABSTRACT

The present invention relates to a system for thawing frozen pipes utilizing electricity. Specifically, the present invention relates to electrically charging a section of frozen pipe such that heat is generated and causes the ice therein to thaw. Even more specifically, the present invention relates to one or more ports disposed above specific portions of pipe that extend upwards towards a surface thereabove and provide electrical access to the specific portions of pipe from the surface.

20 Claims, 9 Drawing Sheets

ELECTRICAL PIPE THAWING SYSTEM AND METHODS OF USING THE SAME

The present invention claims priority to U.S. Provisional Pat. App. No. 62/040,737, titled "Electrical Pipe Thawing System and Methods of Using the Same," filed Aug. 22, 2014, which is incorporated herein by reference in its entirety.

TECHNICAL FIELD

The present invention relates to a system for thawing frozen pipes utilizing electricity. Specifically, the present invention relates to electrically charging a section of frozen pipe such that heat is generated and causes the ice therein to thaw. Even more specifically, the present invention relates to a plurality of ports disposed above pipe junction points that extend upwards towards a surface thereabove that provide access to the pipe junction points from the surface.

BACKGROUND

It is, of course, generally known that liquids freeze at low temperatures. Specifically, water freezes at 32 degrees Fahrenheit and 0 degrees Celsius. It is also generally known that water is provided to homes around the world through pipe systems, wherein the pipes are most often made of metal. These pipes are generally buried in the ground and enter houses at or near the foundation. The ground generally acts to insulate the pipes from the changing temperatures above the surface.

However, during extreme or lengthy cold conditions, the insulation of the ground is not enough to keep water inside of pipes from freezing. This can happen due to extremely low temperatures or from lingering non-extreme low temperatures over a long period of non-use. It is also often the case that a home is not used year round, and may be vacant during winter months as people travel to warmer climates. With no one home to run water through the pipes, the water remains stagnant within the pipes. At cold temperatures and with no water flowing in the pipes to keep the water from freezing, the pipes often freeze and create temporary blocks to subsequent water flow. Unfortunately, this is a recurring problem in most places in the world, especially in cold-weather climes.

Frozen pipes are a serious risk. It is generally known that when water freezes, it expands and can cause strain on the vessel in which it is contained. Often, the strain may cause the vessel holding the water to rupture causing damage to the vessel itself (often a pipe) and may also allow a large amount water to flow from the rupture until repaired. Depending on where the rupture is, a home may flood or otherwise take on water damage, and/or a person may have to pay for the amount of water spilled.

There are many known methods of preventing and thawing frozen pipes. It is generally known that it is harder for moving water to freeze than standing water. Thus, in order to prevent pipes from freezing, people often let faucets drip such that the flow of water is not fully stopped. Insulation may be used to keep pipes warm such as using foam insulation wrap or electrical heat tape. Additionally, heat from a home or a strategically placed heater may prevent ice from forming within pipes. However, when these methods are impossible or fail to work, pipes may still freeze.

When pipes are accessible, heat may be applied to melt the ice therein. Typically, heat from a central heating unit, heater, hair dryer, heating lamp, infrared lamp, or other heating device may be directly applied to the pipe to melt ice therein. This is often done when the pipe that is frozen is accessible and the location of the frozen portion of the pipe is known or discovered. Uncommonly, propane torches or other flame torches have been used to heat pipes to melt ice therein, but are extremely dangerous and create a high risk of fire. A need exists for a safe system and method for thawing frozen pipes.

Hot water may be used in situations where the pipe that is frozen is accessible but the location of the frozen portion of the pipe is unknown or inaccessible. Commonly, hot water is poured into the water line opposite the natural water flow until the hot water contacts the frozen water and melts the ice. Often, a portion of the pipe must be disassembled in order to pour hot water therein, and the pipe must be reassembled before the water begins to flow again to prevent water from spilling everywhere. This process is slow and difficult to control because a person performing this process has no idea when the ice will melt and the water will begin to flow again. A need exists for a fast and controllable system and method to melt ice in a pipe where the location of the frozen portion is unknown or inaccessible. Also, a need exists for a system and method of thawing frozen pipes that are otherwise inaccessible.

Recently, electricity has been used to melt ice within sections of pipe. When electricity travels through a resistive material, which includes conductors, heat is generated. The heat generated melts the ice within the pipes and allows water to flow again. Often, in order to prevent large heat dissipation large voltages are generally used, as is the case in long transmission power lines. However, low voltages may be used in order to create large heat dissipation, which is generally useful to thaw frozen pipes. Therefore, it is often common to apply low voltage to conductive water lines to create large heat dissipation to melt any ice therein. A need exists for a system and method for electrically melting ice from within frozen pipes.

One such product that utilizes electricity to melt ice within pipes is the Icebreaker 350 from Systematics. The Icebreaker 350 requires connecting a first cable to an exposed pipe within a home and another cable to the curb box using a curb key. This method requires attachment of a first electrical lead within a home, which may electrify the pipes within a person's home, and further requires attachment of a second electrical lead to the pipe at the curb box. This method may allow pipes to be thawed between the curb box and a person's home. However, this method may be dangerous, as this method may electrify pipes within a home, which may be a fire hazard.

Often, however, water freezes between the curb box and the water main, which may be quite far from a person's home. A need, therefore, exists for a system and method for safely thawing a frozen pipe with electricity without attachment within a person's home. Additionally, a need exists for a system and method for thawing a frozen pipe beyond the curb box.

Currently, when water freezes between the curb box and the water main, the earth, road, or other interfering material must be excavated to provide access to the frozen portion of the pipe. This process is often time consuming, labor intensive, and expensive. Additionally, a roadway may need to be closed and/or traffic may be diverted because the frozen section of pipe may lie beneath the roadway. It is inefficient and uneconomical to continuously excavate areas where freezing reoccurs. A need, therefore, exists for a system and method that eliminates the need for recurring excavation.

SUMMARY OF THE INVENTION

The present invention relates to a system for thawing frozen pipes utilizing electricity. Specifically, the present invention relates to electrically charging a section of frozen pipe such that heat is generated and causes the ice therein to thaw. Even more specifically, the present invention relates to a plurality of ports disposed above pipe junction points that extend upwards towards a surface thereabove that provide access to the pipe junction points from the surface.

To this end, in an embodiment of the present invention, a system is provided. The system comprises a first port disposed in a surface extending downwardly, terminating at a first portion of a pipe, a second port disposed in the surface extending downwardly, terminating at a second portion of the pipe, and a power source electrically connected to the first portion of the pipe through the first port and to the second portion of pipe through the second port.

In an alternate embodiment of the present invention a method is provided. The method comprises the steps of providing a first port disposed in a surface extending downwardly, terminating at a first portion of a pipe, providing a second port disposed in the surface extending downwardly, terminating at a second portion of the pipe, connecting a power source to the first portion of the pipe through the first port with a first cable, and connecting the power source to the second portion of the pipe through the second port with a second cable.

It is, therefore, an advantage and objective of the present invention to provide a safe system and method for thawing frozen pipes.

It is an advantage and objective of the present invention to provide a fast and controllable system and method to melt ice in a pipe where the location of the frozen portion is unknown or inaccessible.

It is an advantage and objective of the present invention to provide a system and method of thawing frozen pipes that are otherwise inaccessible.

It is an advantage and objective of the present invention to provide a system and method for electrically melting ice from within frozen pipes.

It is an advantage and objective of the present invention to provide a system and method for safely thawing a frozen pipe with electricity without attachment within a person's home.

Additionally, it is an advantage and objective of the present invention to provide a system and method for thawing a frozen pipe beyond the curb service.

It is also an advantage and objective of the present invention to provide a system and method that eliminates the need for recurring excavation.

Additional features and advantages of the present invention are described in, and will be apparent from, the detailed description of the presently preferred embodiments and from the drawings.

BRIEF DESCRIPTION OF THE DRAWINGS

The drawing figures depict one or more implementations in accord with the present concepts, by way of example only, not by way of limitations. In the figures, like reference numerals refer to the same or similar elements.

DETAILED DESCRIPTION OF THE PRESENTLY PREFERRED EMBODIMENTS

The present invention relates to a system for thawing frozen pipes utilizing electricity. Specifically, the present invention relates to electrically charging a section of frozen pipe such that heat is generated and causes the ice therein to thaw. Even more specifically, the present invention relates to a plurality of ports disposed above pipe junction points that extend upwards towards a surface thereabove that provide access to the pipe junction points from the surface.

Figure 1:
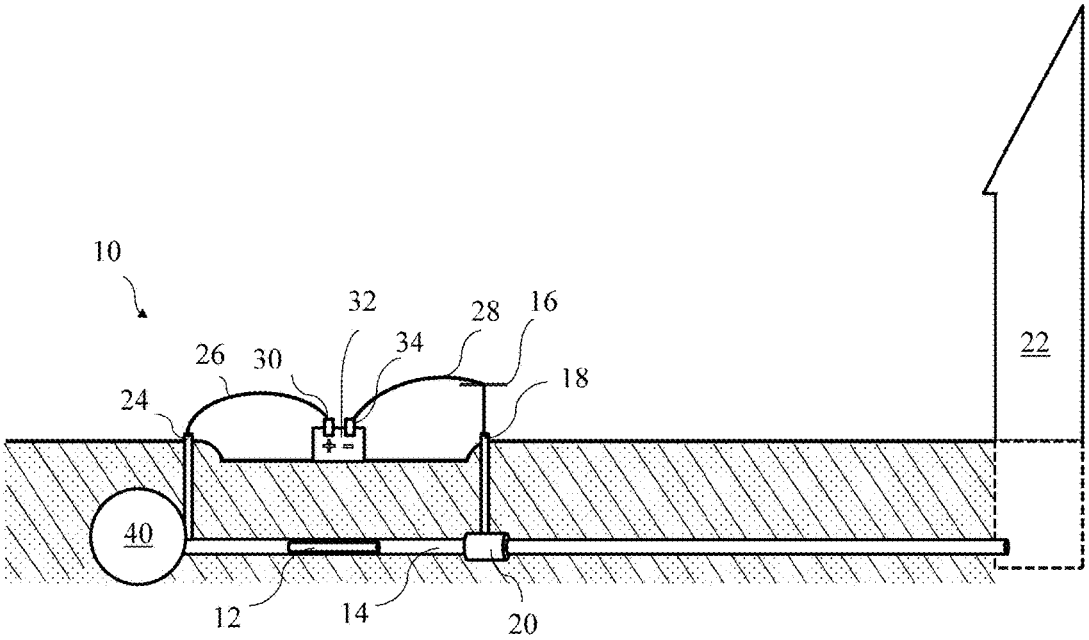
FIG. 1 illustrates a side view of the present invention in an embodiment of the present invention.

Now referring to the figures, wherein like numerals refer to like parts, FIG. 1 illustrates, generally, a system 10 for thawing a frozen blockage 12 from a pipe 14. The frozen blockage 12 may be the frozen form of water, or any other fluid that would otherwise flow through pipes. The system 10 may utilize a curb key 16, which may be disposed within a curb box 18. The curb key 16 may be made of metal or other conductor and may be inserted within the curb box 18, which may attach to a valve 20. The curb key 16 may generally be used to shut off water flow towards a home 22. The curb key 16 may also be used, as in the system 10, to conduct electricity therethrough.

In order to direct the flow of electricity, a closed circuit may be formed. A port 24 may be disposed within a ground surface 35, and may extend downwardly to the pipe 14. The port 24 may be a standard curb box, a pipe, a wire, or device known to one skilled in the art. Specifically, a first cable 26 may attach to the port 24 directly, which may conduct electricity towards the pipe 14. Alternatively, the first cable 26 may traverse through the port 24 and connect to the pipe 14. A second cable 28 may attach to the curb key 16, which may be connected to the pipe 14 through the valve 20. In one embodiment, electricity may flow from a positive terminal 30 of a power source 32 through the first cable 26 and down the port 24 to the pipe 14. The electricity may then flow through the pipe 14 up the curb key 16 and the second cable 28 to a negative terminal 34 of the power source 32.

The pipe 14 may be a conductive material having a resistance. As electricity flows through the pipe 14 the material of the pipe 14 may resist the flow, causing heat to be generated as the resistance of the pipe 14 is overcome. The generated heat may melt an outer layer of the frozen blockage 12, which in turn may allow water or other fluid to flow around the frozen blockage 12. The frozen blockage 12 may thaw as the water or other fluid flows around the frozen blockage 12. Once the frozen blockage 12 is completely melted, water or other fluid may freely flow through the pipe 14 again. Once the water or other fluid begins to flow around the frozen blockage 12, the first cable 26 and the second cable 28 may be detached and/or the power source 32 may be turned off.

Figure 2:
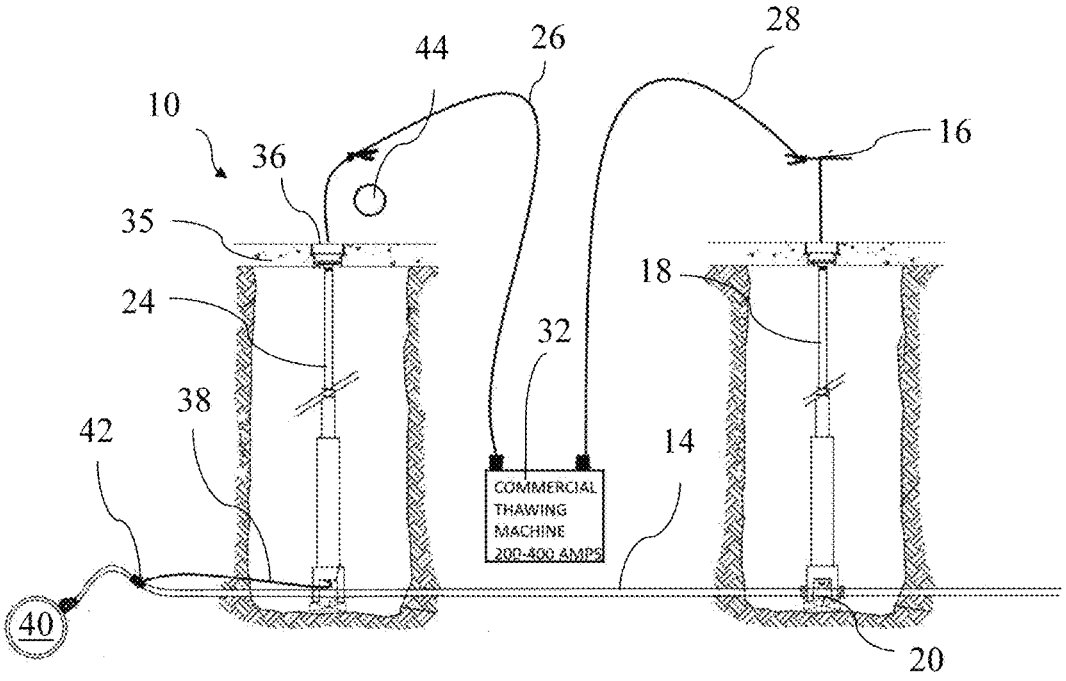
FIG. 2 illustrates a close up view of the present invention in an embodiment of the present invention.

As shown more specifically in FIG. 2, the port 24 may be dug into the earth. In one embodiment, roads or walkways on a ground surface 35 may be excavated and the earth thereunder may be removed to expose the pipe 14. The port 24 may be installed to the pipe 14 and may extend to the ground surface 35, which may be repaired thereafter. An opening 36 may be disposed within the ground surface 35 and may allow future access to the port 24. In one embodiment, a mounting may be disposed within the opening 36 such that the first cable 26 may attach thereto and conduct electricity therethrough.

In a preferred embodiment, a wire 38 may be attached to the pipe 14 at or near a water main 40 below the ground surface 35, as shown in FIG. 2. The wire 38 may be attached to the pipe 14 using a conductive patch 42. The conductive patch 42 may be cylindrical, semi-cylindrical, or another shape that matches the shape of the pipe 14, as further shown in FIGS. 3A-3B. The conductive patch 42 may be made of a conductive material and may create and maintain a secure connection between the wire 38 and the pipe 14. In a preferred embodiment, the conductive patch 42 may be wire brushed bare copper to ensure a good electrical connection. Copper is preferred because it may be more compatible with existing copper and lead lines used with water services. Incompatible metals may result in corrosion or poor connections, which themselves may lead to a welding effect and/or possible pipe breach. Brass may be similarly substituted, but is inferior because it is less flexible.

Figure 3A:
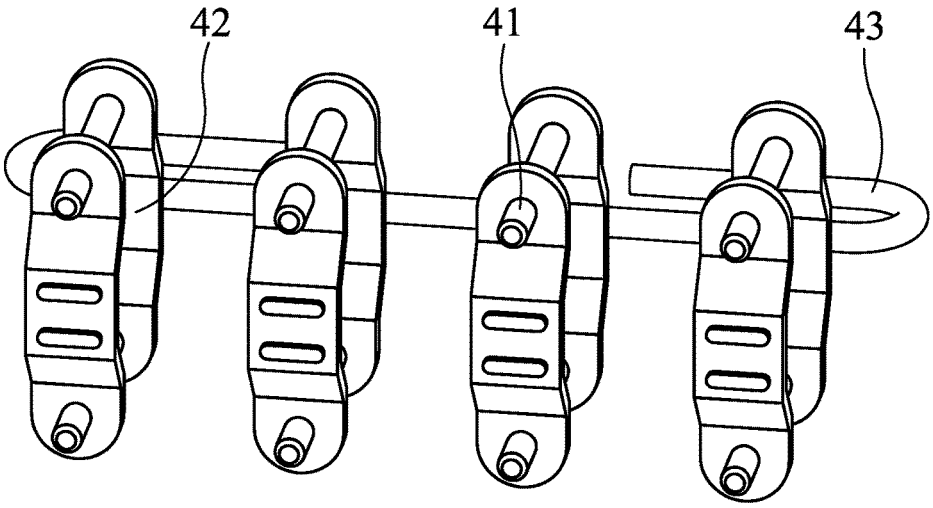
FIGS. 3A-3C illustrates perspective views of embodiments of a conductive patch in an embodiment of the present invention.
Figure 3B:
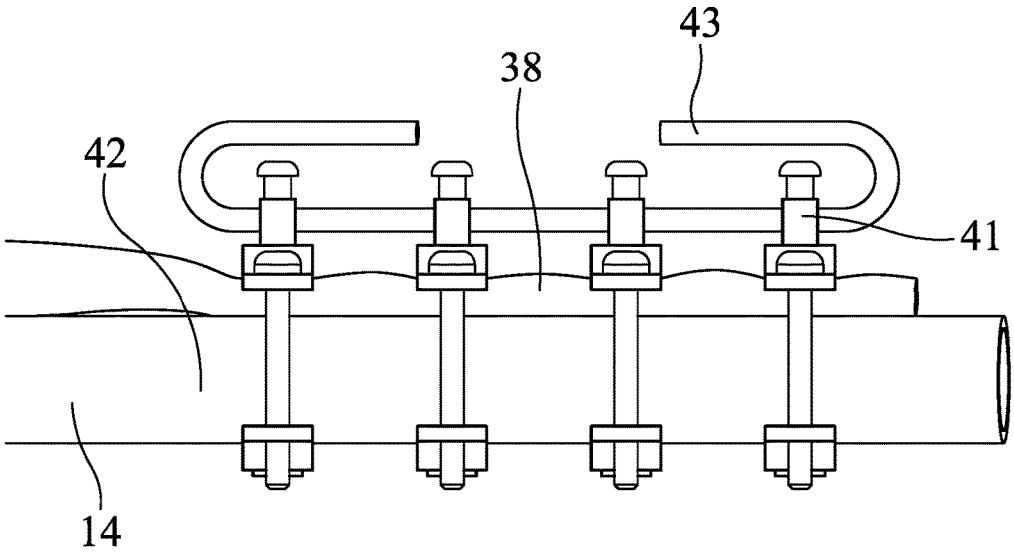

In one embodiment, the conductive patch 42 may be installed around two feet from the water main 40, but may be installed closer or farther as the circumstances provide. The conductive patch 42 may be soldered to the wire 38 and a plurality of clamps 41 may be arranged around the conductive patch 42 and the wire 38. In one embodiment, as shown in FIGS. 3A-3B, four clamps 41 may be used, but of course any number of clamps 41 may be used such that an electrical connection is ensured. Further, the plurality of clamps 41 may be independently tied together with a length of copper 43. Therefore, voltage and current can run from the wire 38 to the conductive patch 42, the clamps 41, and the length of copper 43. The multiple areas of conductivity may allow the conductive patch 42 to have multiple contact points that ensure an electrical connection with the pipe 14.

Specifically, the conductive patch 42 may be positioned around the pipe 14. The conductive patch 42 may be previously connected to the wire 38, or may be attached while attaching the conductive patch 42 to the pipe 14. The clamps 41 may be placed around the wire 38, the conductive patch 42, and the pipe 14. Subsequently, the clamps 41 may be tightened such that the clamps 41 also secure the wire 38 and the conductive patch 42 to the pipe 14. The clamps 41 may also contact a bottom of the pipe 14 that may be uncovered by the conductive patch 42. This connection may be a failsafe to protect against non-connection by any of the aforementioned contact points. It should be noted, however, that the clamps may be connected to the pipe 14 in any orientation taking into consideration ease of installation. A coating may also be applied to the conductive patch 42, the pipe 14, the wire 38, or to any other component herein to prevent corrosion, as the conductive patch 42 and the wire 38 will be buried and exposed to corrosive and oxidative effects of the environment.

Figure 3C:
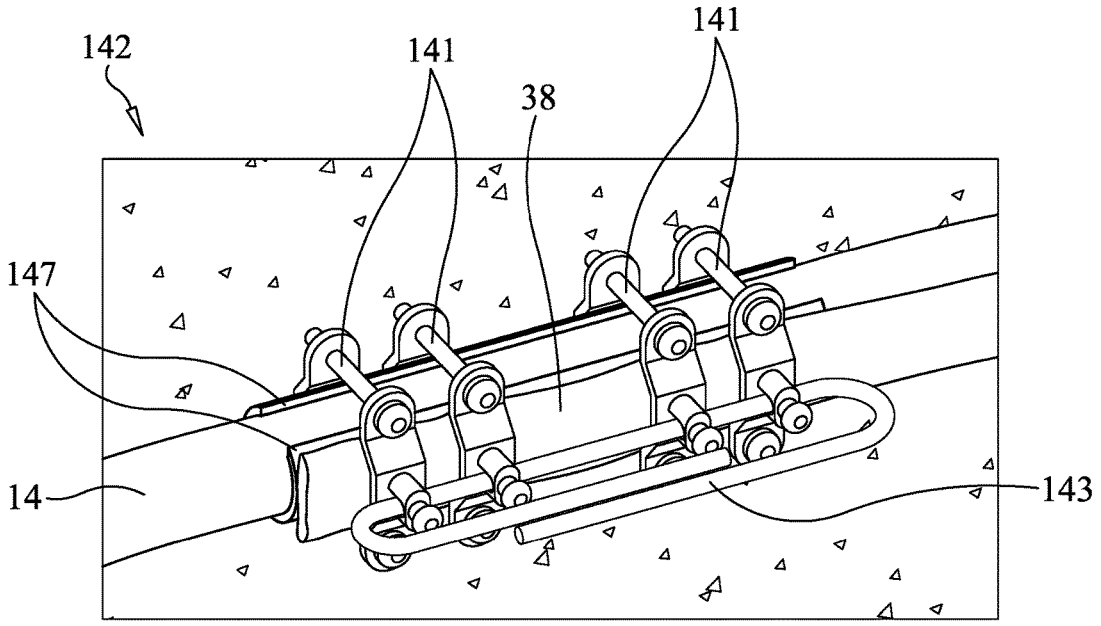

FIG. 3C illustrates an alternate embodiment of a conductive patch 142 having a plurality of clamps 141, each of which is electrically connected to each other via an electrical conductor 143, which may preferably be a wire or cable. The wire 38 may be disposed between the clamps 141 and the pipe 14, as disclosed above with reference to FIGS. 3A and 3B. Further, one or more electrically conductive plates 147 may be disposed between the clamps 141 and the pipe 14 and further between the wire 38 and the pipe 14. The one or more plates 147 may enhance the electrically connection between the wire 38 and the pipe 14. In a preferred embodiment, the one or more plates may be sections of an electrically conductive pipe, such as a copper pipe, having a same or similar circumference to the pipe 14 so that the sections may be disposed on and generally fit over the pipe 14, enhancing the electrical connection between the wire 38 and the pipe 14.

Figure 8:
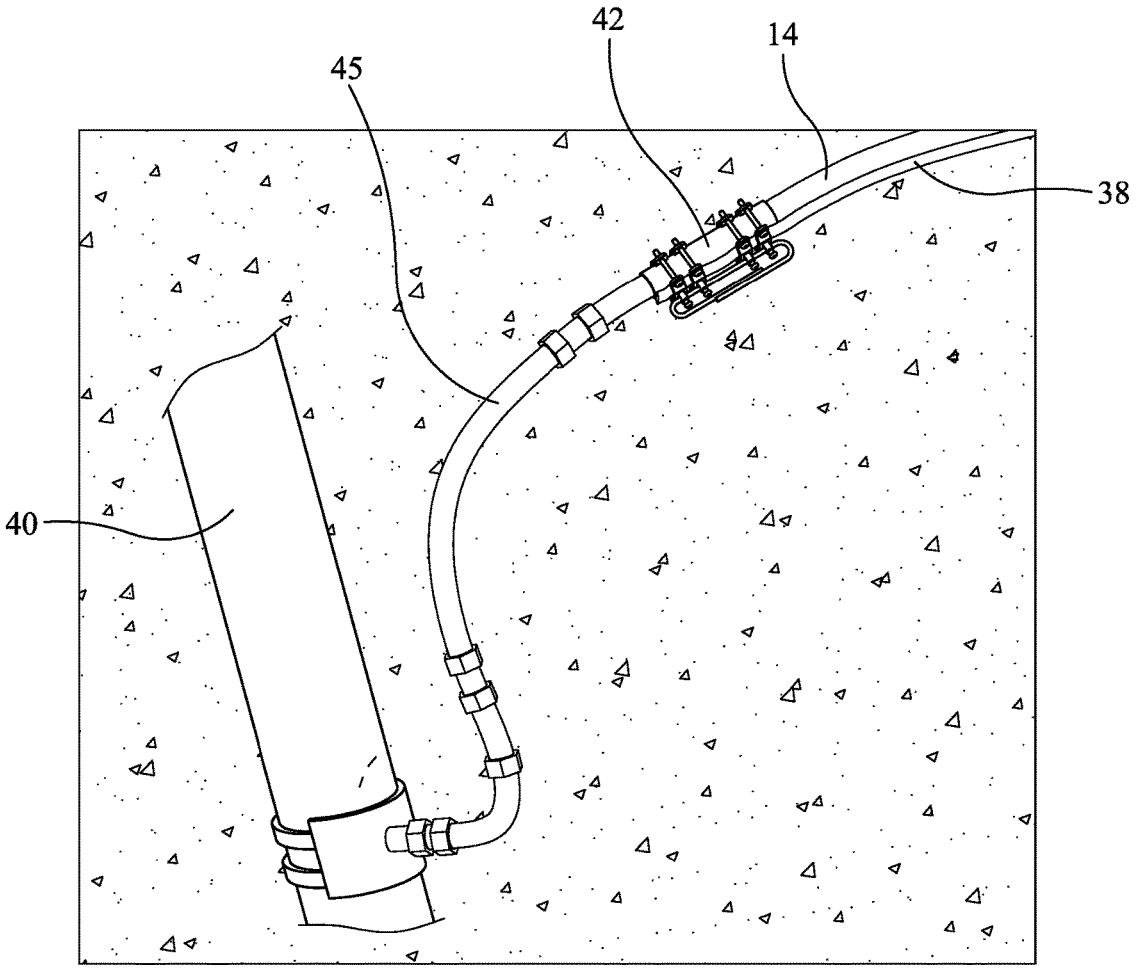
FIG. 8 illustrates a perspective view of an alternate embodiment of an electrically insulated pipe section together with a conductive patch in an embodiment of the present invention.

In an alternate embodiment, shown in FIG. 8, the pipe 14 may be electrically insulated from the water main 40 with the installation of a length of an electrical insulator between the water main 40 and the pipe 14 to isolate the thawing process to the length of the pipe 14 that is frozen, and to prevent current from straying to other parts of the water system, such as into the water main 40 or into a customer's house or building. In a preferred embodiment, a length of non-conductive plastic pipe 45, such as, for example, a length of high density polyethylene (HDPE) may be installed between the water main 40 and the pipe 14 via clamps typically used to install said plastic pipe to the water main 40 and to another pipe 14, as apparent to one of ordinary skill in the art. The conductive patch 42 may be installed on the pipe 14, which is, of course, electrically conductive, for purposes of supplying electrical current thereto to heat the same, as described herein. The length of plastic pipe 45 may thus shield the water main 40 from the electrical current applied to the pipe 14.

The conductive patch 42 may be placed a maximum distance of 95 feet from the curb box 18 when using a power source 32 like a commercial thawing machine with 200-400 amps, as shown in FIG. 2. Of course, alternate power sources may be used to cover larger or smaller distances, as the circumstances provide.

The wire 38 may traverse through the earth and up to the surface 35 through the port 24 or alternatively through the earth itself. If the wire 38 is disposed through the earth, a port 24 may not be necessary, however the wire 38 should be protected and covered in some manner to prevent exposure to the elements and general public. This may be done by using an insulated tube 39, such as the one shown in FIGS. 3A-3B. A mounting may be connected to an end of the wire 38 for electrical connection, or the wire 38 may otherwise attach to the first cable 26 by clamp, bracket, tie, or other connection known to those skilled in the art. The mounting may be similar to the conductive patch 42 or may merely be a conductive plate, preferably copper, connected to the wire 38. A cover 44 may be disposed over the port 24 to safely cover the port 24 when not in use. The wire 38 and any mounting may additionally be hidden under the cover 44. The cover 44 may further be marked to distinguish the port 24 from the curb box 18.

Figure 4:
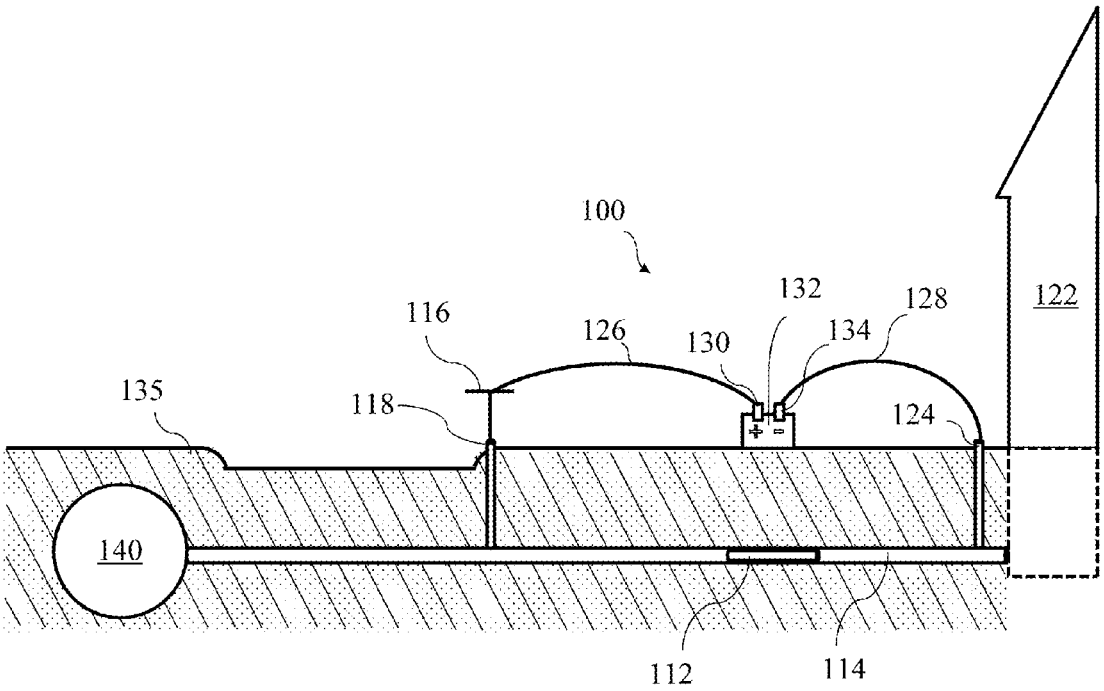
FIG. 4 illustrates a side view of an alternate configuration of the present invention in an embodiment of the present invention.
Figure 5:
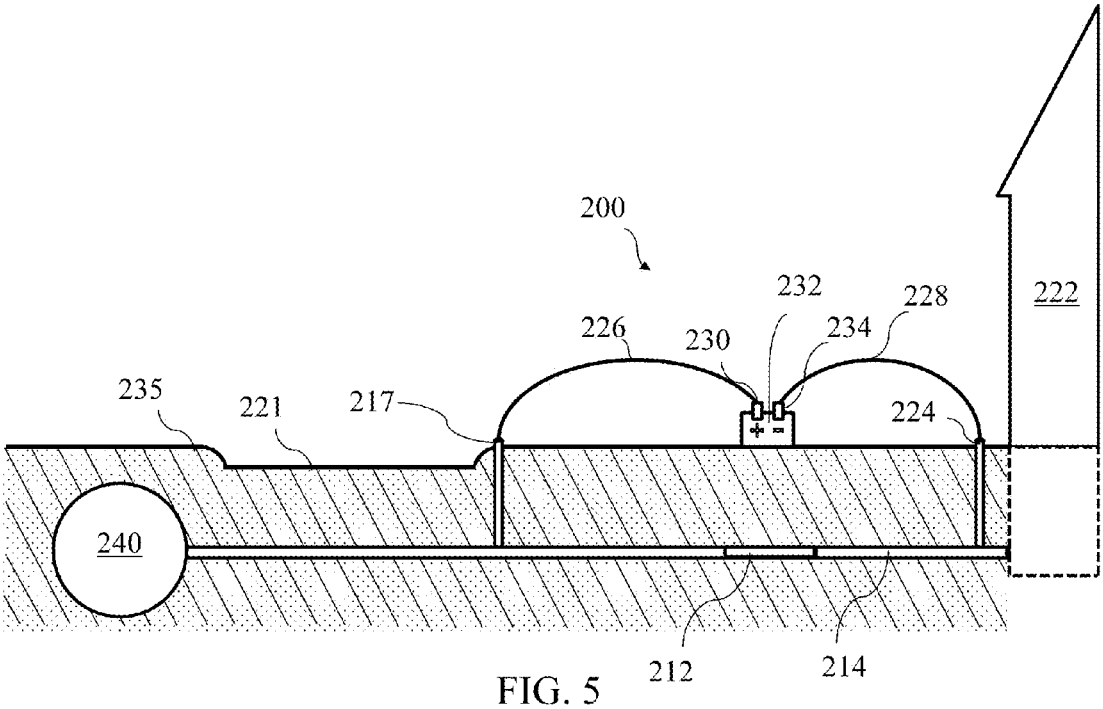
FIG. 5 illustrates a side view of an alternate configuration of the present invention in an embodiment of the present invention.
Figure 6:
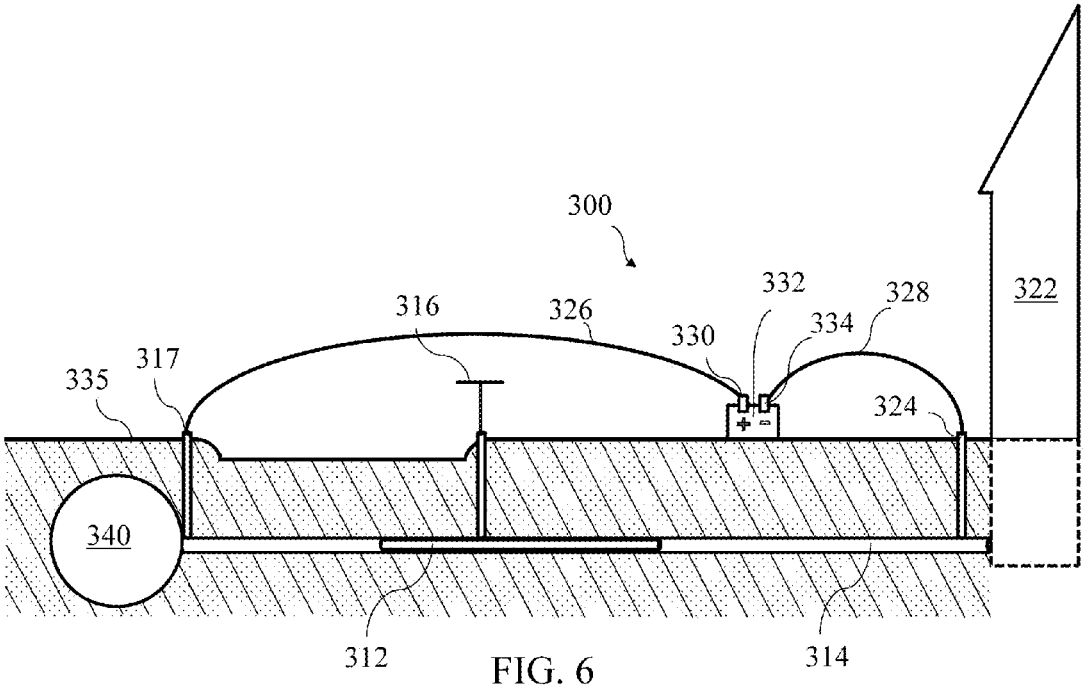
FIG. 6 illustrates a side view of an alternate configuration of the present invention in an embodiment of the present invention.
Figure 7:
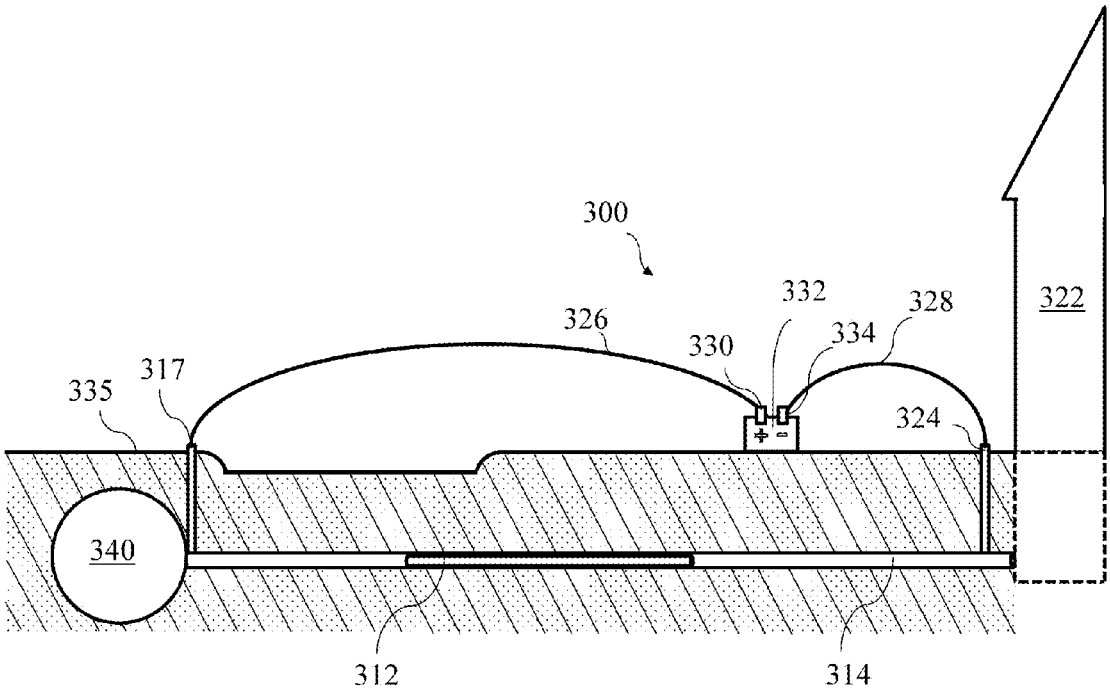
FIG. 7 illustrates a side view of an alternate configuration of the present invention in an embodiment of the present invention.

Of course, the port 24 and the wire 38 may be placed in numerous places, not merely those locations disclosed herein. The port 24 and wire 38 may be placed in locations of recurring freezing, in locations having a high probability of freezing, or any location where excavation is required to get access to a frozen pipe. The port 24 may be installed whenever excavation occurs, such that future excavation in the same area is not necessary. FIGS. 4-6 illustrate alternative locations of the port 24, as further described below.

FIG. 4 illustrates an alternate configuration of the present invention. A system 100 for thawing a frozen blockage 112 from a pipe 114 is shown in FIG. 4. The system 100 may utilize a power source 132 with a positive terminal 130 and a negative terminal 134. The positive terminal 130 may connect to curb key 116 with a first cable 126. The negative terminal 134 may connect to the pipe 114 using a second cable 128 through a port 124, which may extend from a surface 135 to the pipe 114. The port 124 may be disposed close to a home 122, and may be hidden by landscaping. The system 100 may be set up to create a closed loop flow of electricity through the pipe 114, specifically in one embodiment, a frozen section of the pipe 114 wherein the frozen blockage 112 is located. The closed loop flow of electricity may generate heat as the electricity flows past the frozen blockage 112, which may effectively melt the frozen blockage 112.

FIG. 4 illustrates an alternate configuration of the present invention. A system 200 for thawing a frozen blockage 212 from a pipe 214 is shown in FIG. 4. The system 200 may utilize a power source 232 with a positive terminal 230 and a negative terminal 234. The positive terminal 230 may connect to the pipe 214 using a first cable 226 through a first port 217, which may extend from a surface 235 to the pipe 214. The negative terminal 234 may connect to the pipe 214 using a second cable 228 through a second port 224, which may extend from the surface 235 to the pipe 214.

The first port 217 may be disposed a distance near the location of the frozen blockage 212, when known, or the maximum distance allowed by the power source 232, when the location of the frozen blockage 212 is unknown. As shown in FIG. 4, the first port 217 may be disposed near a roadway 221 such that any frozen blockage between the roadway 221 and a home 222 may be thawed. The second port 224 may be disposed close to the home 222, and may be hidden by landscaping. The system 200 may be set up to create a closed loop flow of electricity through the pipe 214, specifically in one embodiment, a frozen section of the pipe 214 wherein the frozen blockage 212 is located. The closed loop flow of electricity may generate heat as the electricity flows past the frozen blockage 212, which may effectively melt the frozen blockage 212.

FIGS. 5-6 illustrate an alternate configuration of the present invention. A system 300 for thawing a frozen blockage 312 from a pipe 314 is shown in FIG. 5. The system 300 may utilize a power source 332 with a positive terminal 330 and a negative terminal 334. The positive terminal 330 may connect to the pipe 314 using a first cable 326 through a first port 317, which may extend from a surface 335 to the pipe 314. The negative terminal 334 may connect to the pipe 314 using a second cable 328 through a second port 324, which may extend from the surface 335 to the pipe 314. The system 300 may be utilized when the frozen blockage 312 extends under and/or beyond a curb key 316, as shown in FIG. 5, or where no curb key exists, as shown in FIG. 6. In one embodiment wherein the frozen blockage 312 extends under and/or beyond a curb key 316, attaching the power source 332 to the curb key 316 may not completely thaw the frozen blockage 312.

The first port 317 may be disposed at or near the location where the pipe 314 intersects with a water main 340. As shown in FIGS. 5-6, the first port 317 may be disposed near the water main 349 such that any frozen blockage in the pipe 314 may be thawed. The second port 324 may be disposed close to a home 322, and may be hidden by landscaping. The system 300 may be set up to create a closed loop flow of electricity through the pipe 314, specifically in one embodiment, the entire pipe 314. The closed loop flow of electricity may generate heat as the electricity flows past the frozen blockage 312, which may effectively melt the frozen blockage 312.

It should be noted that various changes and modifications to the presently preferred embodiments described herein will be apparent to those skilled in the art. Such changes and modifications may be made without departing from the spirit and scope of the present invention and without diminishing its attendant advantages. Further, references throughout the specification to "the invention" are nonlimiting, and it should be noted that claim limitations presented herein are not meant to describe the invention as a whole. Moreover, the invention illustratively disclosed herein suitably may be practiced in the absence of any element which is not specifically disclosed herein.

The invention claimed is:

1. A system for thawing a section of pipe having frozen water therein between a water main and a building, the system comprising:

a water main carrying an amount of water therein;

a building disposed a distance from the water main;

an electrically conductive pipe disposed between the water main and the building, the electrically conductive pipe configured to supply water between the water main and the building, the electrically conductive pipe comprising ice therein causing a blockage of water flow through the electrically conductive pipe;

a conductive patch attached to the pipe at a location in proximity to the water main;

a first electrically conductive wire attached to the conductive patch;

a second electrically conductive wire attached to the pipe at a location in proximity to the building;

an electrical power source disposed between and electrically connected to the first electrically conductive wire and the second electrically conductive wire forming a closed electrical loop through a section of the pipe, wherein, when electricity flows through the first wire, the second wire and the section of the pipe, the resistance of the pipe causes the pipe to heat, thereby thawing ice within the electrically conductive pipe.

2. The system of claim 1 wherein the first electrically conductive wire is disposed between the conductive patch and the pipe.

3. The system of claim 1 wherein the conductive patch comprises at least two electrically conductive clamps.

4. The system of claim 3 wherein at least two electrically conductive clamps further comprise an electrically conductive connector connecting the at least two electrically conductive clamps.

5. The system of claim 4 wherein the electrically conductive connector is a wire.

6. The system of claim 1 wherein the conductive patch comprises an anti-corrosive film.

7. The system of claim 1 further comprising at least one electrically conductive plate disposed between the first electrically conductive wire and the pipe configured to enhance the electrical connection between the wire and the pipe.

8. The system of claim 1 further comprising:

an electrically insulated pipe section disposed between the water main and the electrically conductive pipe.

9. The system of claim 8 wherein the electrically insulated pipe section is made from plastic.

10. The system of claim 1 further comprising a port connected to the pipe, wherein the second conductive wire is attached to the port.

11. A method for thawing a section of pipe having frozen water therein between a water main and a building, the system comprising:

providing a water main containing an amount of water flowing therein;

providing a building disposed a distance from the water main;

providing an electrically conductive pipe disposed between the water main and the building, the pipe configured to supply water between the water main and the building, the electrically conductive pipe comprising ice therein causing a blockage of water flow through the electrically conductive pipe;

electrically connecting a first electrically conductive wire to the electrically conductive pipe at a location in proximity to the water main;

electrically connecting a second electrically conductive wire to the pipe at a location in proximity to the building;

electrically connecting an electrical power source to the first electrically conductive wire and the second electrically conductive wire forming a closed electrical loop through a section of the pipe, wherein, when electricity flows through the first wire, the second wire and the section of the pipe, the resistance of the pipe causes the pipe to heat, thereby thawing the ice within the electrically conductive pipe.

12. The method of claim 11 further comprising the steps of:

connecting a conductive patch to the pipe at a location in proximity to the water main; and connecting the conductive patch to the first electrically conductive wire.

13. The method of claim 12 wherein the first electrically conductive wire is disposed between the conductive patch and the pipe.

14. The method of claim 13 further comprising at least one electrically conductive plate disposed between the first electrically conductive wire and the pipe configured to enhance the electrical connection between the wire and the pipe.

15. The method of claim 12 wherein the conductive patch comprises at least two electrically conductive clamps.

16. The method of claim 15 wherein at least two electrically conductive clamps further comprise an electrically conductive connector connecting the at least two electrically conductive clamps.

17. The method of claim 12 wherein the conductive patch comprises an anti-corrosive film.

18. The method of claim 11 further comprising:

connecting an electrically insulated pipe section between the water main and the electrically conductive pipe.

19. The method of claim 18 wherein the electrically insulated pipe section is made from plastic.

20. The method of claim 11 further comprising the steps of:

providing a port connected to the pipe; and connecting the second conductive wire to the port.

* * * * *